US010344343B2

(12) United States Patent
Epps

(10) Patent No.: US 10,344,343 B2
(45) **Date of Patent: *Jul. 9, 2019**

(54) MULTIPLE CHAMBER MATERIAL-STIRRING LANCE AND METHOD

(71) Applicant: Larry J Epps, Butler, PA (US)

(72) Inventor: Larry J Epps, Butler, PA (US)

( * ) Notice: Subject to any disclaimer, the term of this patent is extended or adjusted under 35 U.S.C. 154(b) by 236 days.

This patent is subject to a terminal disclaimer.

(21) Appl. No.: 15/432,130

(22) Filed: Feb. 14, 2017

(65) Prior Publication Data

US 2017/0362672 A1 Dec. 21, 2017

Related U.S. Application Data

(63) Continuation-in-part of application No. 15/183,020, filed on Jun. 15, 2016.

(51) Int. Cl.

| | |
|---|---|
| ***C21C 5/46*** | (2006.01) |
| ***C21C 7/072*** | (2006.01) |
| ***F27D 27/00*** | (2010.01) |
| ***F27D 3/16*** | (2006.01) |
| ***C21C 7/00*** | (2006.01) |
| ***C21C 7/064*** | (2006.01) |
| ***F27D 3/00*** | (2006.01) |

(52) U.S. Cl.

CPC ..... *C21C 5/4606* (2013.01); *C21C 7/0037* (2013.01); *C21C 7/0075* (2013.01); *C21C 7/064* (2013.01); *C21C 7/072* (2013.01); *F27D 3/0033* (2013.01); *F27D 3/16* (2013.01); *F27D 27/00* (2013.01); *C21C 5/4613* (2013.01); *F27D 2003/169* (2013.01); *F27D 2027/002* (2013.01)

(58) Field of Classification Search

CPC ..... C21C 5/4606

See application file for complete search history.

(56) References Cited

U.S. PATENT DOCUMENTS

| | | | |
|---|---|---|---|
| 3,901,445 | A | 8/1975 | Chang |
| 4,550,898 | A | 11/1985 | Labate |
| 4,588,170 | A | 5/1986 | Towns |
| 46,673,865 | | 5/1987 | Colzani |

(Continued)

FOREIGN PATENT DOCUMENTS

| | | |
|---|---|---|
| GB | 973521 | 10/1964 |

*Primary Examiner* — Scott R Kastler

(74) *Attorney, Agent, or Firm* — Karen Tang-Wai Sutton

(57) ABSTRACT

A multiple chamber material-stirring lance and method used to treat molten metal in a ladle, the lance having a stirring gas chamber, and a plurality of gas permeable ports arranged at a terminal end of the gas chamber, and at least one material chamber positioned parallel to the gas chamber and terminating in a plurality of material ports. In use, the multiple chamber material-stirring lance is lowered into the ladle of molten metal, and gas and material are both introduced into a respective chamber and emitted through their respective ports. Stirring gas emitted through the gas permeable ports under a gas pressure between 40 and 600 cfm causes the stirring gas to create a boiling effect in the molten metal, drawing material into the stirring gas bubbles and away from the lance body, improving material dispersion efficiency and thus impurity extraction from the molten metal.

16 Claims, 7 Drawing Sheets

(56) References Cited

U.S. PATENT DOCUMENTS

| | | | | |
|---|---|---|---|---|
| 4,991,752 | A * | 2/1991 | LaBate | B22D 41/58 222/590 |
| 5,015,291 | A | 5/1991 | Skach | |
| 5,188,661 | A | 2/1993 | Cook et al. | |
| 5,308,043 | A | 5/1994 | Floyd | |
| 5,328,157 | A | 7/1994 | Mantey | |
| 5,336,293 | A | 8/1994 | Freissmuth | |
| 5,972,072 | A | 10/1999 | Kinsman | |
| 6,322,610 | B1 | 11/2001 | Pavlicevic | |
| 7,396,503 | B2 | 7/2008 | Cameron | |
| 7,563,405 | B2 | 7/2009 | Decastro | |
| 9,206,487 | B2 | 12/2015 | Hicks | |
| 9,259,780 | B2 | 2/2016 | Waitlevertch | |
| 2009/0229416 | A1 | 9/2009 | Cameron | |
| 2014/0298955 | A1 | 10/2014 | Okuyama et al. | |
| 2016/0053333 | A1 | 2/2016 | Hicks | |
| 2017/0362672 | A1* | 12/2017 | Epps | C21C 5/4606 |

* cited by examiner

SECTION A-A

SECTION D-D

SECTION E-E

SECTION A-A

SECTION B-B
UPPER

SECTION B-B
MIDDLE

SECTION B-B
LOWER

SECTION C-C
UPPER

SECTION C-C
LOWER

SECTION D-D

SECTION E-E

MULTIPLE CHAMBER MATERIAL-STIRRING LANCE AND METHOD

CROSS REFERENCE TO RELATED APPLICATIONS

The present application claims priority from and is a continuation-in-part of U.S. application Ser. No. 15/183,020 filed 15 Jun. 2016, which itself claims priority from U.S. provisional application Ser. No. 62/180,826 filed 17 Jun. 2015.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION BY REFERENCE OF MATERIAL SUBMITTED ON A COMPACT DISC OR AS A TEXT FILE VIA THE EFS WEB SYSTEM

Not applicable.

STATEMENT REGARDING PRIOR DISCLOSURES BY THE INVENTOR OR A JOINT INVENTOR

Not applicable.

BACKGROUND OF THE INVENTION

(1) Field of the Invention

The present invention pertains to the field of hot metal processing equipment and a method of using such equipment, for instance when making steel and iron.

(2) Background Art

The present invention relates to removal of impurities from a quantity of molten hot metal in a ladle during ironmaking, or alternatively, during steelmaking, as both processes use similar equipment and methods. References to steelmaking hence are also applicable to ironmaking and the use of the term "steelmaking" here is meant to include ironmaking as well. Slag is a term of art in the steelmaking industry referring to waste impurities produced when a desired metal has been separated from its raw ore, and typically floats to the surface of the molten metal. The impurities are skimmed off the surface of the molten or hot metal before the metal is sent for processing. Presence of impurities affects the quality and characteristics of the finished products, consolidating and efficiently removing impurities reduces production costs, and improves yield and metal quality.

Currently, steelmakers use two methods to separate waste or impurities from hot metal: (1) material methods that introduce desulfurizing agents deep into the hot metal to chemically bind the sulfur for easier removal, and (2) stirring methods that physically stir the hot metal by creating turbulence to agitate the body of metal so as to allow better distribution of desulfurizing agents and thus allow the desulfurizing agents to work more efficiently.

For material methods, material (desulfurizing agents) are commonly delivered into the hot metal via a typical "straight" through lance, one of many configurations of lances used in steelmaking, the lance consisting of a pipe or chamber with the majority of the length coated with a refractory material. The purpose of the refractory coating is to prevent the pipe from melting or distorting while submerged in the hot (molten) metal. This type of lance simply delivers the injected material to the bottom of the ladle with a minimum amount of stirring of the material into the hot metal. The only stirring gas available is provided by the gas which conveys the material into the ladle and/or the vaporization material.

A known issue with material methods using lances is the lack of uniform dispersion of material into the hot metal. The reagent is only present in sufficient quantities in around the lance itself, as the material-gas bubble typically will simply follow the lance exterior body up to the slag line, resulting in a decreased effectiveness in removing sulfur impurities from the entire body of hot metal. It is also known that a stirring gas without any material introduced into the hot metal also tends to follow the lance exterior body up to the slag line, reducing its effectiveness to stir the material into the hot metal.

Regarding the material and stirring methods, the prior art teaches that use of the stirring method is optional when using a material injection method, although steelmakers often use the stirring method in conjunction with the material method as this typically results in better mixing of reagent and thus increased removal of impurities from the hot metal.

Another type of material lance design is a "T" lance, in which the bottom of the main pipe is shaped like an inverted letter "T" so as to move the material away from the lance in two different directions. This process is an improvement over the other lance style since it moves the material away from the lance and thus improves distribution of the material to a degree by creating two reaction zone in the hot metal. While useful, U.S. Pat. No. 5,188,661 (Cook et al.) granted 23 Feb. 1993 discusses some of the drawbacks of the T lance, including the problem of uneven material distribution caused by blockages of one of the two ports and thus resulting in undesired splashing of the hot metal.

For stirring methods, a rotary lance has been developed to physically stir the hot metal, by rotating the lance while submerged in the hot metal via a motor and speed reducer system. The main drawback to this system is that it must be installed above a lance drive, which requires the lance drive to be of a substantial structure to be able to support the additional weight of the machinery needed to rotate the lance.

The prior art teaches the use of both material and stirring methods together, as well as separately, however in reality, most steelmakers are forced by economic reasons to use only one method as the capital investments required for both methods is often cost prohibitive. For instance, a highly effective material-stirring lance is described in U.S. Pat. No. 9,259,780 B2 (Waitlevertch et al.) granted 16 Feb. 2016, for which the present inventor is also a co-inventor, the main drawback of this system is the need for costly modifications to existing equipment in order to support the weight of the machinery required to rotate the lance, again adding to capital costs, and downtime to do such modifications.

What is needed is an improved lance that increases efficiency and requires no significant nor expensive investments or modification to existing equipment, and is cost effective for steelmakers.

BRIEF SUMMARY OF THE INVENTION

In a first aspect of the invention, a multiple chamber material-stirring lance for removing impurities from a quantity of hot metal in a ladle during steel or ironmaking comprises at least one gas chamber formed with a gas connection pipe at a first end and terminating in at least one lower gas port, and at least one material chamber parallel to the gas chamber having a material connection pipe at a first end and terminating in at least one material discharge port at a second end, both chambers encased by a refractory coating so as to form a single lance body. The lower ports are gas permeable structures that restrict and regulate a flow of gas out of the gas chamber and configured such that the flow of gas introduced into the gas chamber and emitted through the gas permeable structures with a cfm of gas between 40 and 600 cfm into the quantity of hot metal form a plurality of bubbles smaller than a plurality of bubbles emitted from a gas permeable structure that does not restrict nor regulate the flow of gas out of the gas chamber.

In a second aspect of the invention, the material chamber terminates in a pipe having a pair of opposed material discharge ports forming an inverted T-configuration.

In yet a third aspect of the invention, the at least one material discharge port is positioned at a lowermost terminal end of the material chamber.

In yet a forth aspect of the invention, the gas chamber is further comprised of at least one body port formed into a length of the gas chamber, leading out of the gas chamber and exiting the refractory coating and wherein the at least one body port is a gas permeable structure that restricts and regulates the flow of gas out of the gas chamber, including porous plugs, directional plugs, and nozzles.

In yet a fifth aspect of the invention, a method of using a multiple chamber material-stirring lance having at least one material chamber and at least one gas chamber during a steel purification process, comprises the steps of positioning the multiple chamber material-stirring lance vertically into a quantity of hot metal inside a ladle, introducing a quantity of material into the material chamber, introducing a volume of stirring gas into the gas chamber, discharging the quantity of material from the material chamber through at least one material port and into the quantity of hot metal and discharging the volume of stirring gas through the lower ports where the exiting gas has a cfm between 40 and 600 cfm, where the discharged gas forms a plurality of bubbles simulating a boiling effect in the hot metal.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1:
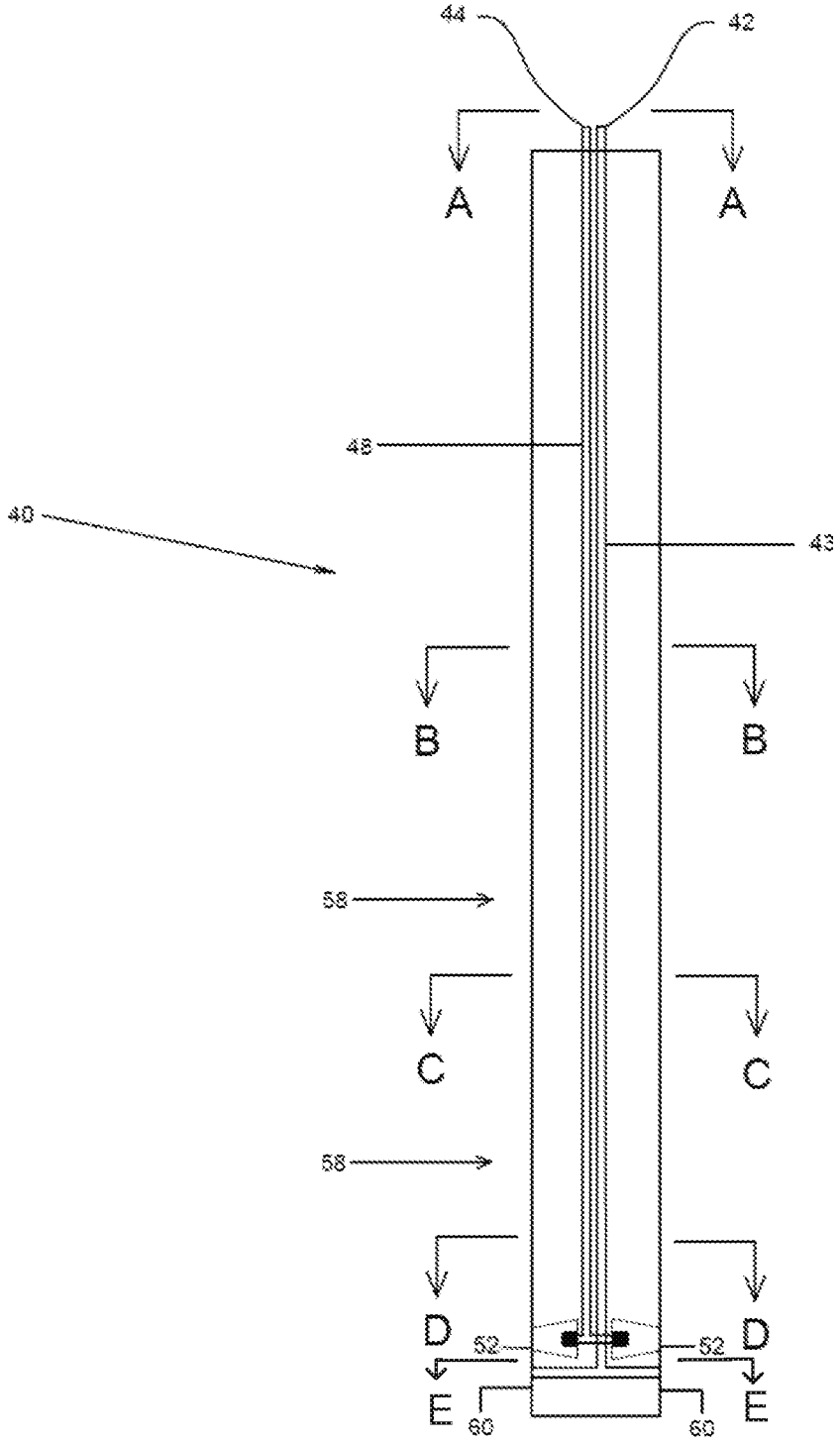
FIG. 1 is a side elevation, cross sectional view of a first embodiment of a multiple chamber material-stirring lance according to the invention, where a single material chamber is adjacent and parallel to a single gas chamber.

The following is a list of reference labels used in the drawings to label components of different embodiments of the invention, and the names of the indicated components.

2 ladle
4 slag pot
5 desulfurization reagent or material
6 hot metal
6*a* surface of hot metal
8 ladle spout
10 gas bubbles
24 slag
40 multiple chamber material-stirring lance
42 material connection pipe
43 material chamber
44 gas connection pipe
46 refractory coating
48 stirring gas chamber or gas chamber
50 body stirring port or body port
52 lower stirring port or lower port
60 material discharge port

GLOSSARY OF IMPORTANT TERMS

Hot metal or molten metal: metal heated to a temperature such that the metal is in a liquid state, and includes metals commonly purified by heating in a ladle such as steel and iron Material: desulfurization reagent or reagents Port: when referring to a port of a gas chamber, a structure capable of passing gas, including but not limited to porous plugs, directional plugs, pipes, and nozzles, and when referring to a port of a material chamber, a structure that allows material to pass through.

DETAILED DESCRIPTION

A multiple chamber material-stirring lance 40 and method of use is shown in FIGS. 1-7

Figure 1A:
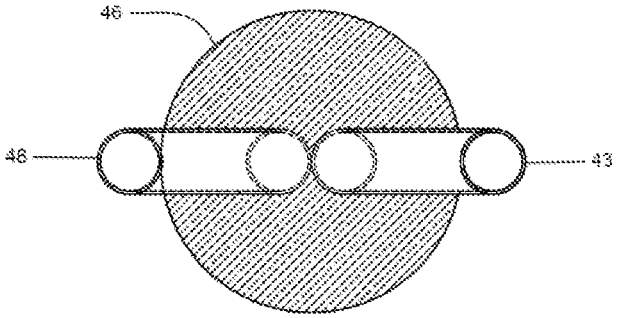
FIG. 1*a* is a top cross sectional view of the multiple chamber material-stirring lance in FIG. 1 taken along section A-A.
Figure 1B:
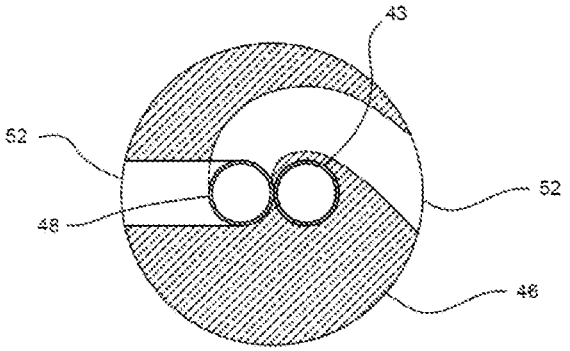
FIG. 1*b* is a top cross sectional view of the multiple chamber material-stirring lance in FIG. 1 taken along section D-D, showing a configuration of gas ports.
Figure 1C:
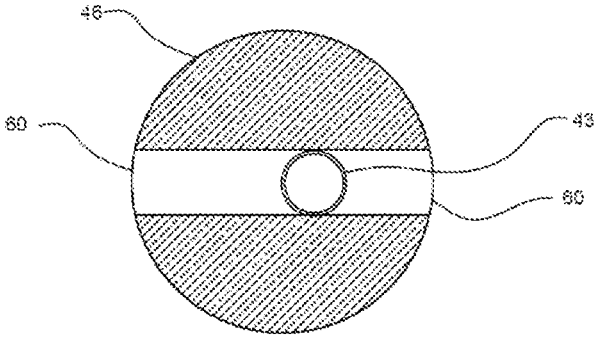
FIG. 1*c* is a top cross sectional view of the multiple chamber material-stirring lance in FIG. 1 taken at section E-E in having a T-material port configuration.
Figure 7:
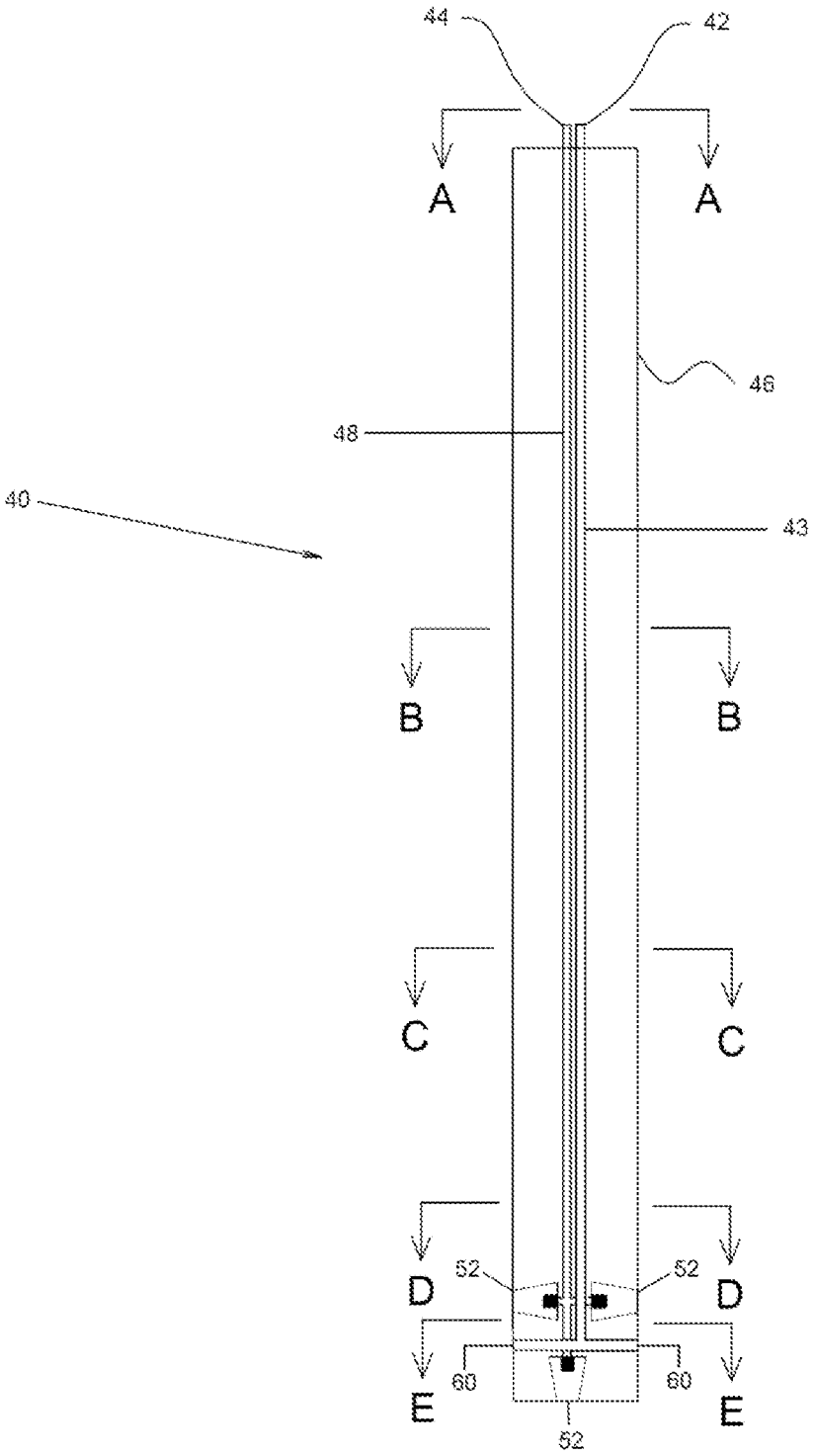
FIG. 7 is a side cross sectional view of the multiple chamber material-stirring lance of FIG. 1, shown with a lower port 52 configuration wherein a lower port 52 is positioned at a lowermost terminal end of the gas chamber with the port opening parallel to the gas chamber.

Turning now to FIG. 1, in a first embodiment the multiple chamber material-stirring lance 40 is shown in a side elevation, cross sectional view and in FIGS. 1*a-c*, showing the lance of FIG. 1 from several top cross sectional views, the multiple chamber material-stirring lance comprising a pair of parallel chambers, a first chamber being a stirring gas or gas chamber 48 having a gas connection pipe 44 at an uppermost end, a body having a length formed leading from the gas chamber 48 to an exterior of the gas chamber, and terminating in at least one or more lower stirring ports or lower ports 52 positioned at a lowermost end of the gas chamber 48. FIG. 7 shows a typical lower port 52 configuration when the gas chamber terminates in three lower ports 52. The lower ports 52 are typically directional plugs, porous plugs, nozzles, pipes or some other type of structure capable of passing gas which emit relatively smaller gas bubbles as compared to a simple open pipe end that freely allows gas to be discharged from the gas chamber 48.

A material chamber 43, located adjacent to the gas chamber, having a material connection pipe 42 at an uppermost end terminates in one or more material discharge ports 60 at a lowermost end of the material chamber 43. While not shown in the Figures, when a single material port 60 is used, the port exit opening is typically located at a lowermost terminal end of the material chamber (straight lance configuration). A lance refractory coating 46 covers and encases the exterior of the gas chamber to protect it from damage caused by submerging the multiple chamber material-stirring lance 40 into a quantity of hot metal 6 in a ladle 2, the lower ports 52 allowing gas present in the gas chamber 48 to exit the multiple chamber material-stirring lance 40.

Figure 2:
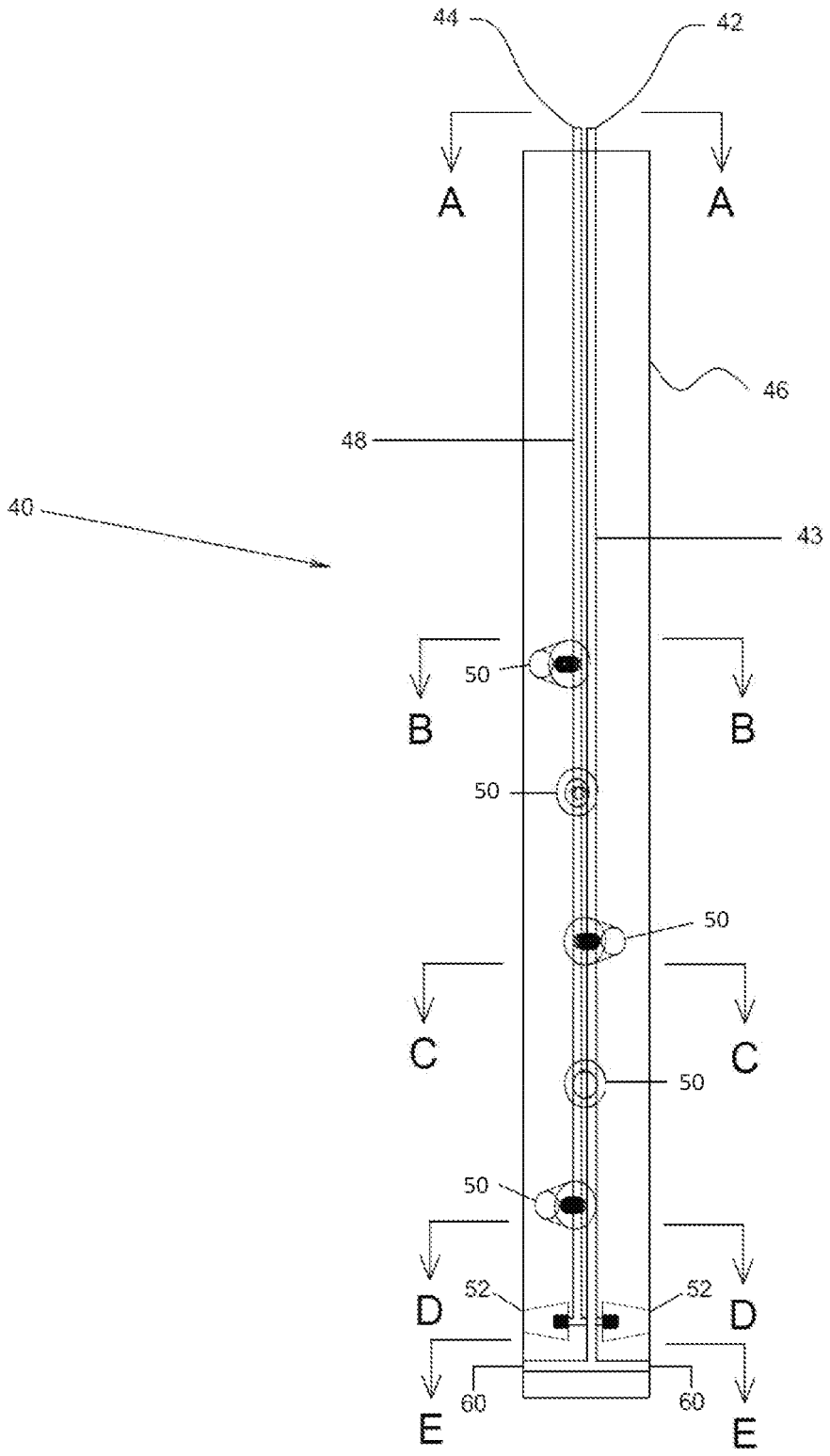
FIG. 2 is a side elevation, cross sectional view of a second embodiment of the multiple chamber material-stirring lance featuring an array of body ports along a body length of the gas chamber.
Figure 2A:
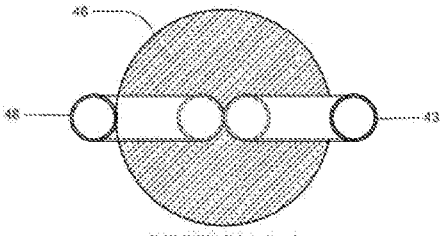
FIGS. 2*a-h* are top cross sectional views of the multiple chamber material-stirring lance of FIG. 2 taken along sections A-A, B-B (upper section, middle section, lower section), C-C (upper section and lower section), D-D, and E-E, respectively.
Figure 2B:
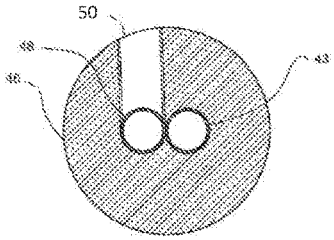
Figure 2C:
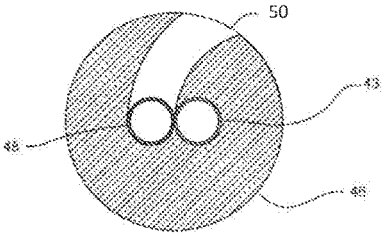
Figure 2D:
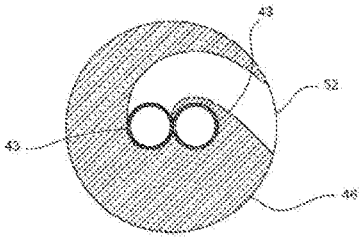
Figure 2E:
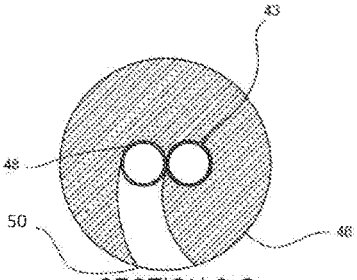
Figure 2F:
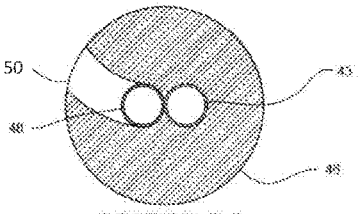
Figure 2G:
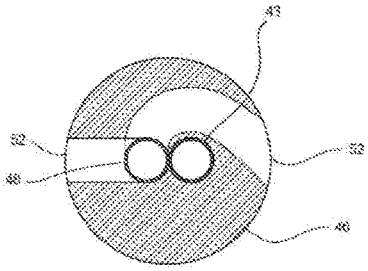
Figure 2H:
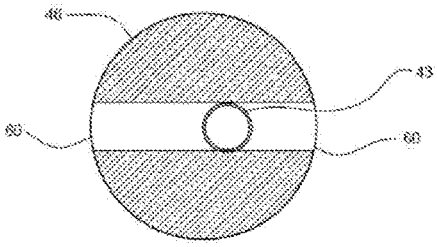
Figure 3:
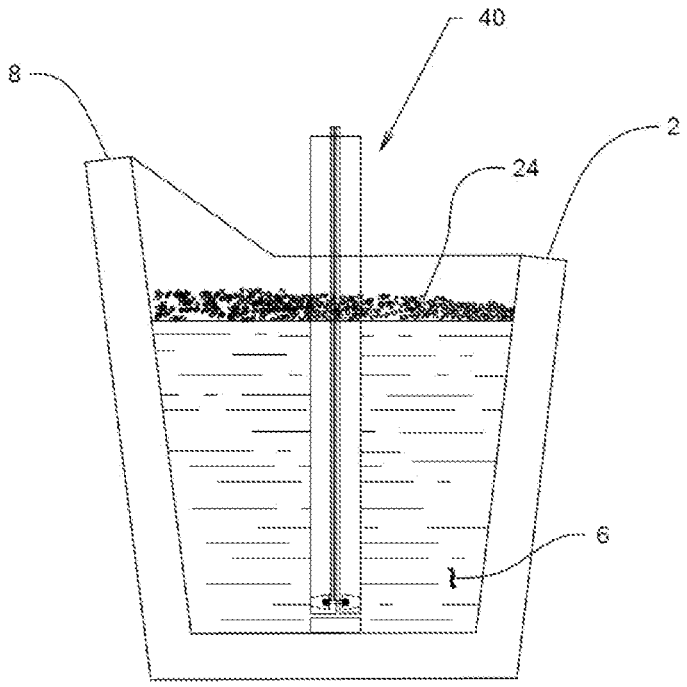
FIGS. 3-4 are side cross sectional views of a method of using the multiple chamber material-stirring lance of FIG. 1 shown with the lance in a ladle of hot metal.

FIGS. 2 and 2*a-h* are side and top cross sectional views of a second embodiment of the multiple chamber material-stirring lance 40, where the gas chamber 48 is formed with at least one or more body ports 50 formed into a length of the gas chamber 48 above the lower ports 52. The body ports 50, like the lower ports 52, are directional and/or porous structures that emit relatively smaller gas bubbles as compared to an open pipe end that does not limit or otherwise alter the flow rate of the gas from the gas chamber. The inventor notes that gas ports, whether they are lower ports 52 or body ports 50, are structures that control the flow of gas out of the gas chamber and into the hot metal. In contrast, material ports 60 allow material, such as powdered reagent with a gas carrier such as nitrogen to freely exit the material ports without regulation. The array of body ports shown in FIG. 2 is one example of a typical array of body ports and is not meant to limit the invention to just this particular array. A single body port along the length of the gas chamber body, or two body ports along the length of the gas chamber body above the lower ports 52, for instance are also suitable variations of the array shown in FIG. 2 and would also effectively carry and mix the material into the hot metal inside the ladle.

Figure 4:
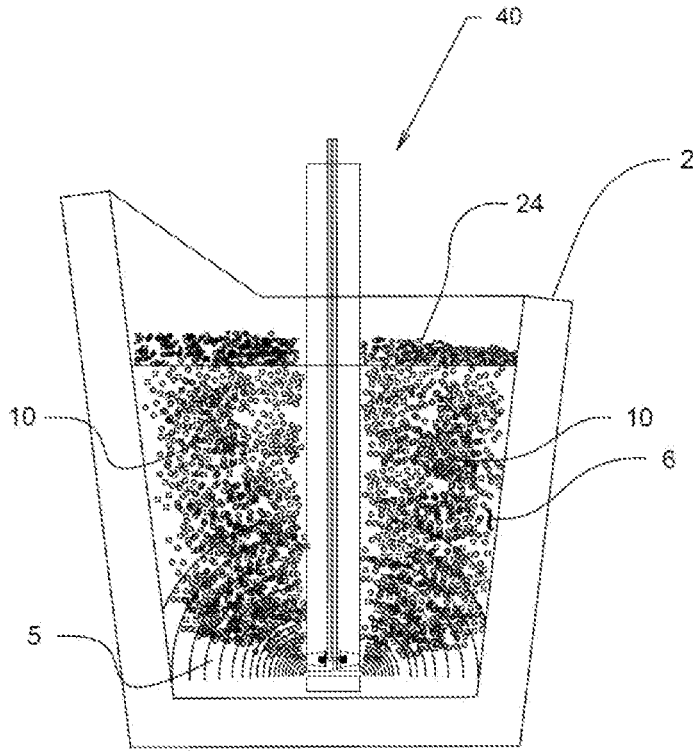
Figure 5:
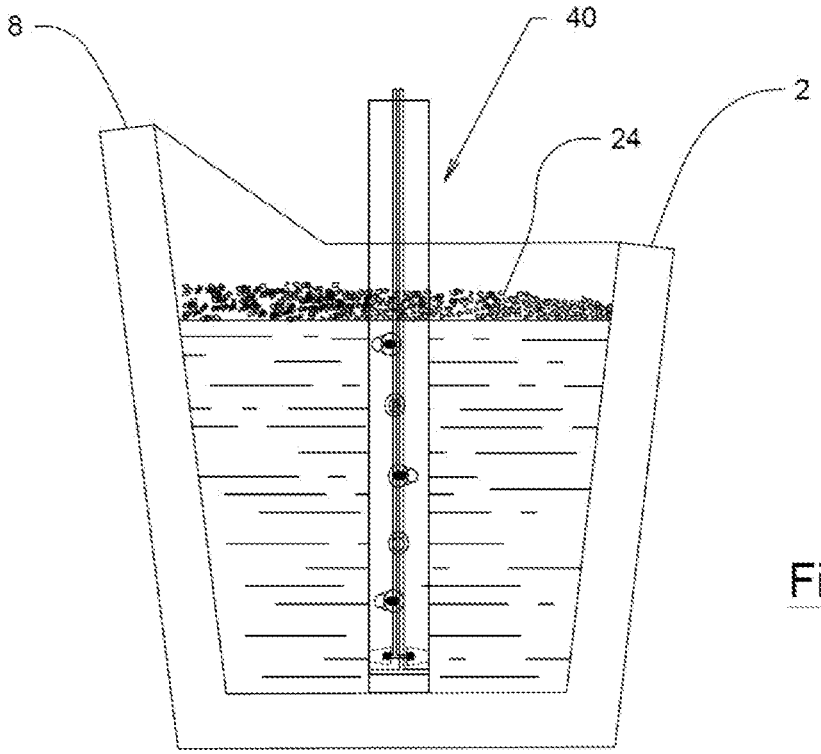
FIGS. 5-6 are side cross sectional views of a method of using the multiple chamber material-stirring lance of FIG. 2 shown with the lance in a ladle of hot metal.
Figure 6:
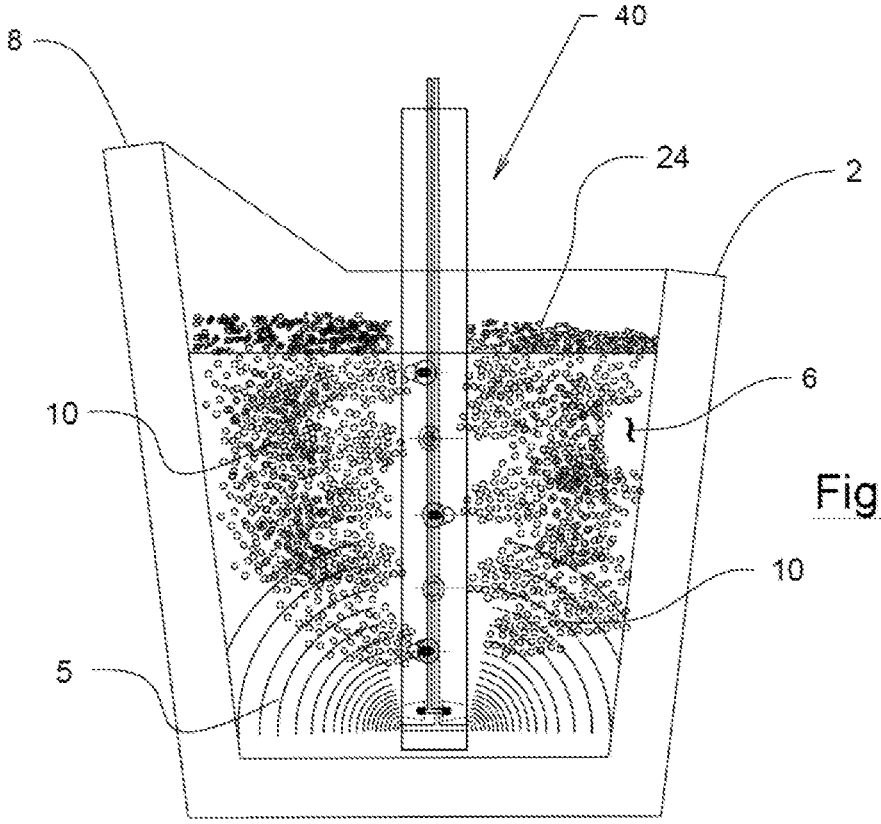

Turning now to FIGS. 3-6 a method of using the multiple chamber material stirring lance 40 is described. During desulfurization, the multiple chamber material-stirring lance 40 is positioned vertically into the ladle 2 containing the hot metal 6. A quantity of desulfurizing reagent or material 5 is deposited into the material chamber 43 via the material connection pipe 42, and exits the material chamber 43 via the material discharge ports 60 and into the hot metal 6. A volume of gas is introduced through the stirring gas connection pipe 44 and discharged into the hot metal 6 via the lower ports 52, as in FIGS. 3-4 or through the lower ports 52 and an array of ports 50 arranged along the length of the gas chamber, as in FIGS. 5-6, at a same time as the material 5 is discharged into the hot metal, or at a time, as determined by a mill operator controlling the desulfurization process. As shown in FIGS. 3-6, the gas is introduced below a surface 6*a* of the hot metal 6 and a plurality of bubbles 11 from the gas disperses the material 5 throughout the hot metal 6, resulting in increased reaction between reagent and sulfur, forming slag 24 that moves to the surface of the hot metal and floats along the surface 6*a*, to be later removed by skimming. The use of pipes, nozzles, directional or porous port structures for the lower stirring ports 52 and/or the plurality of body ports 50 results in relatively smaller bubbles, and when gas introduced into the gas chamber 48 is under relatively higher pressure, typically between 40-600 cfm, the escaping gas bubbles create a "boiling effect" in which a plurality of small bubbles mixing with the reagents or vaporized material outwards and into the hot metal, enhancing the mixing of material with the hot metal, resulting in a more efficient desulphurization process. FIGS. 4 and 6 illustrate the "boiling effect" of the bubbles emitted into the quantity of hot metal, resulting in a more efficient dispersion of the material throughout the hot metal as compared to prior art mixing methods. The boiling effect of the gas bubbles moves the material outwards and away from the lance body, exposing the material to more sulfur and capturing it, so it can carry it to the slag layer for removal.

When the multiple chamber material-stirring lance 40 is in use, the material 5 is dispersed from the material ports 60 and stirring gas bubbles 11 emitted from the lower gas ports 52 and/or the plurality of body ports 50 create turbulence in the hot metal 6. The inventor notes that the lower gas ports 52 of the multiple chamber material-stirring lance can also be configured as an array of ports about the terminal end of the gas chamber 48, where a series of pipes radiate outwards from the chamber 48 with each pipe ending in porous and/or directional port structures that regulate the flow of gas so as to control the boiling effect of the stirring gas bubbles and to allow the creation of different stirring gas patterns, as desired.

The inventor notes that while the Figures show a single material chamber and a single gas chamber, it is possible to introduce multiple material and multiple gas chambers within a same lance body. The inventor notes the stirring gas can be introduced into the hot metal with or without material also being introduced, providing the mill operator flexibility of use of the multiple chamber material-stirring lance 40. The inventor stresses that his use of the term "port", in the singular or plural, includes any gas permeable structure such as porous or directional plugs, nozzles, and pipes, and the Figures may show a particular type of port, such as a porous plug as an example of a suitable structure and is not meant to limit the meaning of "port" to only refer to the specific type of structures as shown in the Figures but is meant to illustrate one type of suitable port according to the invention. The inventor also notes that directional plugs, which have a gas permeable slit or slot are also suitable gas permeable structures for use with the invention. The term "porous plugs" also includes plate type porous material. Port size, regardless of the type of permeable structure used, varies between 0.125 to 5 inches (0.315 to 12.7 cm) in diameter and the lance can be manufactured so as to vary port sizes in a single lance, according to desires or needs of the mill operator. Varying port sizes will impact the volume of gas flowing through the ports relative each other.

The inventor notes the multiple chamber material-stirring lance 40 provides many benefits to the mill operator. The weight of the lance 40 for instance, is essentially the same as that of a standard prior art lance. Thus the multiple chamber material-stirring lance 40 can be installed onto an existing lance drive system with no structural modifications required. The only modifications to the lance drive system consist of an additional gas manifold and an additional hose to a top of the lance 40 to deliver gas to the lance 40, relatively simple and inexpensive modifications.

The mill operator using the multiple chamber material-stirring lance is afforded significant cost reductions and efficiency/quality increases. Steelmaking efficiency is improved without incurring the additional capital equipment cost as required by the prior art systems, and as the multiple chamber material-stirring lance 40 is a combined material and gas stirring lance, only a single lance must be replaced. The mill operator may use gas only, or have gas and material introduced into the hot metal simultaneously, or at different times or different frequencies, as desired, allowing the mill operator the most flexibility and functionality with a single lance, and represents significant cost savings for the mill operator, as a single lance (and its requisite equipment) can achieve a same or better results as the dual material lance systems previously patented, and without substantive capital investment by the mill operator.

It is to be understood the above-described arrangements are only illustrative of the application of the principles of the present invention. Numerous modifications and alternative arrangements may be devised by those skilled in the art without departing from the scope of the present invention. For instance, the invention is shown with chambers and the exterior lance body as being generally cylindrical in shape, with a circular cross section, however other shapes, such as triangular and hexagonal prisms, with triangular and hexagonal cross sections, cubes and cuboid, with square and rectangular cross sections, or other three dimensional shapes, even spherical or irregular can also be used. The inventor stresses that the combination of gas and material chambers in a single lance, the port configurations which maximize mixing of material within the hot metal, and the ability to control the volume and/or rate of flow of stirring gas via port size, type, and location are key features of the multiple chamber material-stirring lance. Whether the chambers have square or other shaped cross sections, or flat walls versus curved, are variations that are inconsequential to the functioning of the invention, and the circular cross sections shown in the Figures are not meant to exclude these other possible shapes for the coaxial chambers but are just an example of one possible useful shape.

The inventor also notes that the array of body ports shown in FIG. 2 is one example of a typical array of body ports and is not meant to limit the invention to just this particular array. A single body port along the length of the gas chamber body, or two body ports along the length of the gas chamber body above the lower ports 52 are also suitable variations of the array shown in FIG. 2 and would also effectively carry and mix the material into the hot metal inside the ladle.

What is claimed is:

1. A multiple chamber material-stirring lance (40) for use in a hot metal desulfurization process performed in a mill having a motorized lance drive with a lance weight support capacity, a ladle having a bottom joined to a continuous side wall holding a predetermined quantity of hot metal, and a gas manifold supplying a gas supply, where the multiple chamber material-stirring lance is supported by the motorized lance drive in the predetermined quantity of hot metal in the ladle, the multiple chamber material-stirring lance comprising:

a gas chamber (48) having a first end and a terminal end, and a length between the first end and the terminal end defining a chamber wall, the chamber wall further defining an interior space having an interior wall side facing the interior space and an opposed outer wall side;

a gas connection pipe (44) at the first end coupled to the gas manifold and to the gas supply;

at least one lower port (52) positioned into the chamber wall and leading out of the terminal end of the gas chamber (48) to an exterior of the multiple chamber material-stirring lance (40);

a material chamber (43) having a first end and a second end, the first end connected to a material connection pipe (42) and the second end terminating in at least one material discharge port (60);

a material chamber length between the first end and second end defining a material chamber wall, the material chamber wall having an exterior wall side; and a refractory coating (46) encasing both the opposed outer wall side of the gas chamber and the exterior wall side of the material chamber so as to form a single lance body;

wherein the exterior wall side of the material chamber (43) is adjacent to the outer wall side of the gas chamber (48);

wherein the at least one lower port (52) is a gas permeable structure having a body formed with an inlet at one end and an opposed outlet, the inlet secured to a through-hole formed into the chamber wall, and the opposed outlet positioned relative to the refractory coating so as to allow fluid communication between the interior space of the gas chamber and the predetermined quantity of hot metal immediately beyond the refractory coating, the opposed outlet having a diameter measurement between about 0.5 cm to about 13 cm; and wherein the at least one lower port is at least one of a pipe, a nozzle, a porous plug, and a directional plug.

2. The multiple chamber material-stirring lance (40) in claim 1, wherein the material chamber (43) terminates in a pipe having a pair of opposed material discharge ports (60), a terminal end of the material chamber and ports forming an inverted T-configuration.

3. The multiple chamber material-stirring lance (40) in claim 1, wherein the at least one material discharge port (60) is positioned at a lowermost terminal end of the material chamber.

4. The multiple chamber material-stirring lance (40) in claim 1, wherein the gas chamber (48) is further comprised of:

at least one body port (50) positioned into the length of the gas chamber; and wherein the at least one body port is a gas permeable structure having a body formed with an inlet at one end and an opposed outlet, the body inlet secured to a through-hole formed into the chamber wall, and the opposed body outlet positioned relative to the refractory coating so as to allow fluid communication between the interior space of the gas chamber and the predetermined quantity of hot metal immediately beyond the refractory coating, the opposed body outlet having a diameter measurement between about 0.5 cm to about 13 cm;

wherein the at least one body port is at least one of a pipe, a nozzle, a porous plug, and a direction plug; and wherein the at least one body port is positioned between the first end of the gas chamber and the at least one lower port.

5. The multiple chamber material-stirring lance (40) of claim 1, wherein the at least one lower port (52) is configured to emit a volume of gas between 40 and 600 cfm.

6. A method of using the multiple chamber material-stirring lance (40) in claim 1, the method comprising the steps of:

Positioning the multiple chamber material-stirring lance vertically into a quantity of hot metal inside a ladle;

Introducing a quantity of material into the material chamber;

Introducing a volume of stirring gas into the gas chamber;

Discharging the quantity of material from the material chamber through at least one material port and into the quantity of hot metal; and Discharging the volume of stirring gas through the lower port where the stirring gas is emitted with a cfm between 40 and 600 cfm, the discharged gas forming a plurality of bubbles simulating a boiling effect in the hot metal.

7. The method of claim 6, wherein the steps of discharging the quantity of material and discharging the volume of stirring gas is performed simultaneously.

8. The multiple chamber material-stirring lance in claim 1, wherein the opposed outlet of the at least one lower port is positioned in the gas chamber wall directly above and in vertical spaced apart relationship with the at least one material discharge port.

9. The multiple chamber material-stirring lance in claim 4, further comprising a second body port and a third body port, wherein the at least one body port, the second body port and the third body port are arranged as a spiral array of ports about the gas chamber wall having at least two of the body ports in vertical spaced-apart relationship about the gas chamber wall separated by no more than 45 degrees about the gas chamber wall circumference such that the at least two ports are vertically unaligned.

10. A method of using the multiple chamber material-stirring lance having at least one material chamber and at least one gas chamber of claim 9 during a steel purification process, the method comprising the steps of:

Positioning the multiple chamber material-stirring lance vertically into a quantity of hot metal inside a ladle;

Introducing a quantity of material into the material chamber;

Introducing a volume of stirring gas into the gas chamber;

Discharging the quantity of material from the material chamber through at least one material port and into the quantity of hot metal; and Discharging the volume of stirring gas through the lower ports where the stirring gas is emitted with a cfm between 40 and 600 cfm, and where the discharged gas forms forming a plurality of bubbles simulating a boiling effect in the hot metal.

11. The multiple chamber material-stirring lance (40) of claim 1, further comprising a second material chamber having an exterior wall adjacent the exterior wall of the material chamber and the outer wall of the gas chamber, and wherein the exterior wall of the second material chamber is encased by the refractory coating (46).

12. The multiple chamber material-stirring lance (40) in claim 1, wherein the material chamber (43) terminates in a pipe having a pair of opposed material discharge ports (60).

13. The multiple chamber material-stirring lance (40) in claim 11, wherein the material discharge ports are opposed pairs of material discharge ports.

14. The multiple chamber material-stirring lance (40) in claim 1, further comprising a terminal lower port (52) leading out of the terminal end of the gas chamber (48) to an exterior of the multiple chamber material-stirring lance (40).

15. The method of claim 6, wherein the step of discharging the volume of stirring gas is performed after the step of introducing the volume of stirring gas into the gas chamber and before the step of discharging the quantity of material from the material chamber.

16. The method of claim 10, wherein the step of discharging the volume of stirring gas is performed after the step of introducing a volume of stirring gas and before the step of discharging the quantity of material.

* * * * *